US005542380A

United States Patent [19]

Chatten

[11] Patent Number: 5,542,380

[45] Date of Patent: Aug. 6, 1996

[54] INTEGRATED DYNAMIC AIR CLEANER

[75] Inventor: J. Keith Chatten, Shreveport, La.

[73] Assignee: WCI Outdoor Products, Inc., Cleveland, Ohio

[21] Appl. No.: 412,149

[22] Filed: Mar. 28, 1995

[51] Int. Cl.[6] ..... F01P 1/02

[52] U.S. Cl. ..... 123/41.7; 123/198 E; 123/41.65; 55/438; 55/DIG. 14; 55/DIG. 28

[58] Field of Search ..... 123/198 E, 41.65, 123/41.7; 55/437, 438, 473, 471, DIG. 14, DIG. 28

[56] References Cited

U.S. PATENT DOCUMENTS

| | | | |
|---|---|---|---|
| 3,855,976 | 12/1974 | Notaras et al. | 123/41.62 |
| 3,994,067 | 11/1976 | Hazzard et al. | 30/383 |
| 4,261,302 | 4/1981 | Sheldon | 123/41.7 |
| 4,438,733 | 3/1984 | Sasaki | 123/41.62 |
| 4,537,160 | 8/1985 | Shirai | 123/41.58 |
| 4,841,920 | 6/1989 | Andreasson et al. | 123/41.66 |
| 4,946,482 | 8/1990 | Tamba et al. | 55/320 |
| 5,083,538 | 1/1992 | Hubbell | 123/198 E |
| 5,121,715 | 6/1992 | Nogami et al. | 123/41.7 |
| 5,231,956 | 8/1993 | Lux et al. | 123/41.65 |
| 5,269,265 | 12/1993 | Pretzsch et al. | 123/41.56 |
| 5,317,997 | 6/1994 | Tomitaku | 123/41.7 |
| 5,367,988 | 11/1994 | Collins | 123/198 E |

*Primary Examiner*—Noah P. Kamen

*Attorney, Agent, or Firm*—Pearne, Gordon, McCoy & Granger

[57] ABSTRACT

An improved centrifugal air cleaning system including a fan, a fan volute defined, in part, by a curved outer wall and a base wall, and a deflector wall projecting from the base wall intermediate the fan and the outer wall. An air inlet port is formed in the base wall and is located between the deflector wall and the outer wall. The deflector wall includes a first wall portion and a second wall portion. The first wall portion has a curvature generally matching a curvature of the fan while the second wall portion diverges from the fan toward the outer wall. The first wall portion prevents radially projected particles from reaching the air inlet port while the second wall portion cooperates with the outer wall to define a restricted flow path downstream of the air inlet port that creates a relatively high pressure condition at the inlet port and injects substantially particle-free air into the carburetor.

23 Claims, 4 Drawing Sheets

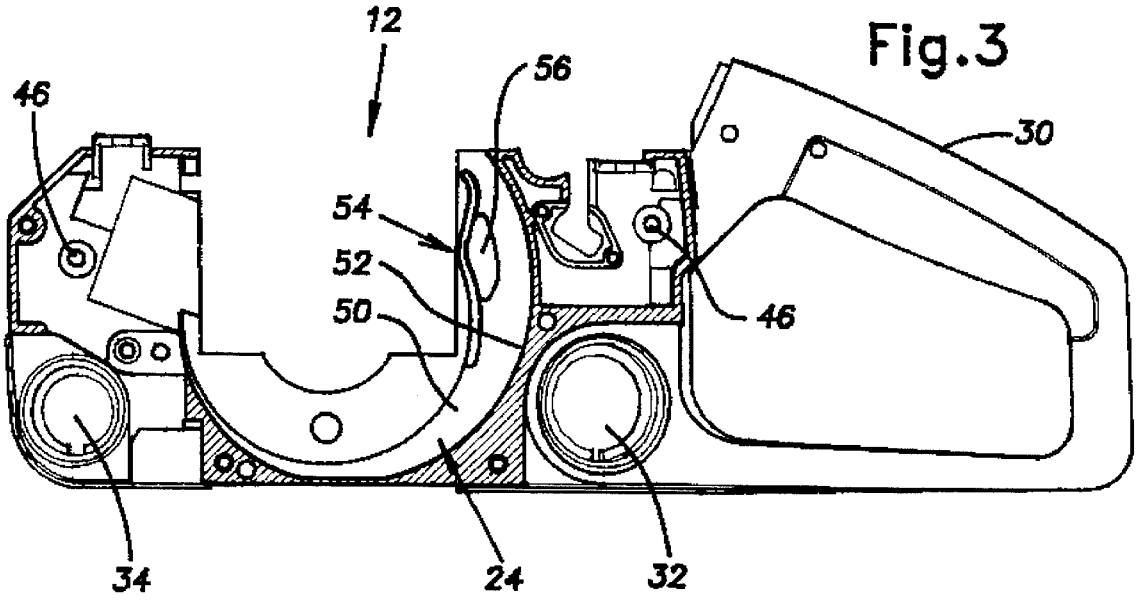
Fig.3
Fig.4
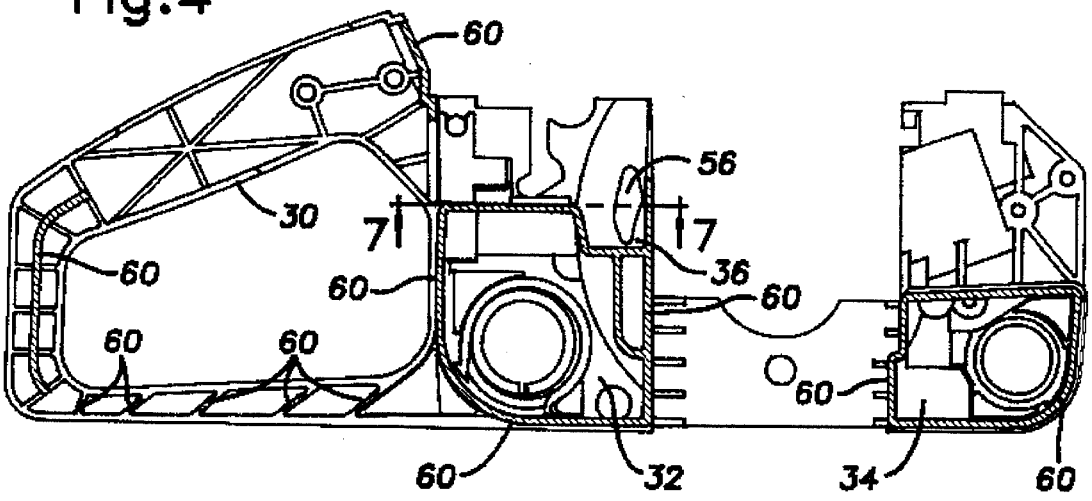

Fig.5
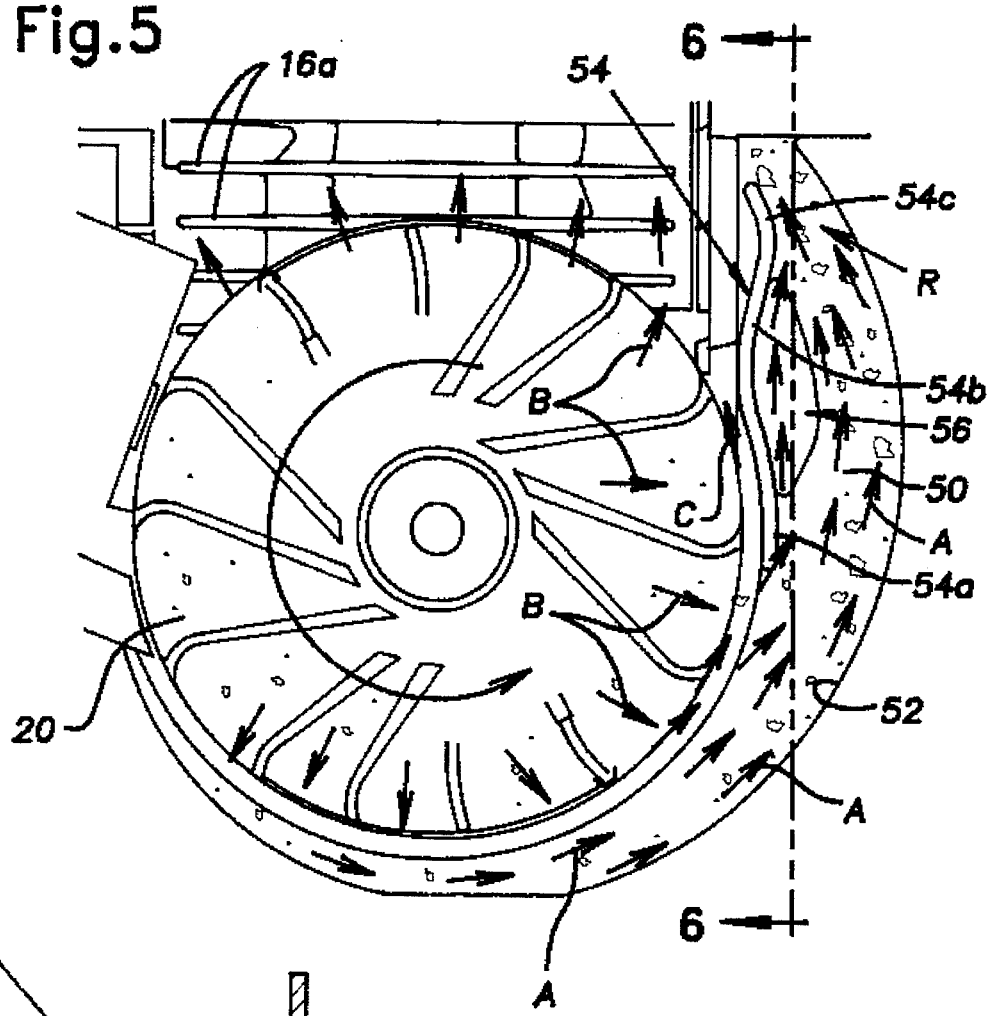
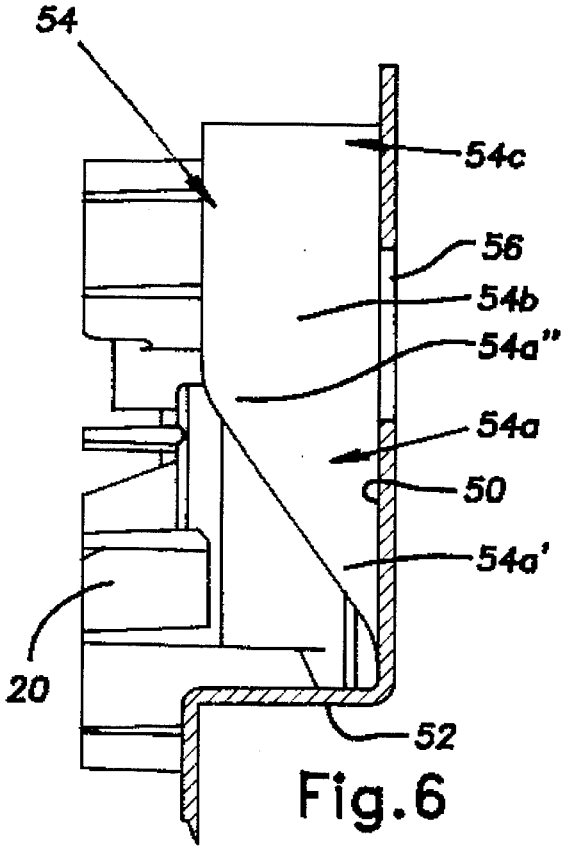
Fig.6

INTEGRATED DYNAMIC AIR CLEANER

BACKGROUND OF THE INVENTION

The present invention generally relates to air cleaners and, more particularly, to dynamic or centrifugal air cleaning systems for portable power tools.

In portable power tools, such as chain saws, blowers, string trimmers, and hedge trimmers, significant attention has been paid to methods for removing dirt and particles from ambient air prior to its introduction into the carburetor. Typically, such methods employ a filter media which traps and separates entrained particles from the air stream prior to introduction of the air into the carburetor. However, in dirty or dusty conditions, which is a common operating environment for portable power tools, the filter media quickly becomes saturated or clogged with filtered particles and tends to resist or impede air flow, leading to degradation of the power tool performance. Thus, the filter media must be periodically cleaned or replaced, and represents a serious problem to the operator from a stand point of convenience and down-time.

In response to this problem, air cleaning methods have been developed to take advantage of the centrifugal effects or forces present in an air stream flowing within a fan volute radially surrounding a fan or flywheel of the power tool. In this regard, it has been recognized that dirt or heavier-than-air particles tend to be entrained in the fastest moving portion of the air stream adjacent the radially outermost portion of the fan volute while the radially innermost portion of the air stream is relatively slower moving, and tends to be free of entrained particles.

One known centrifugal air cleaning method employs an air inlet tube having an inlet opening disposed Within the fan volute between the fan and a curved outer wall which defines the outermost extent of the volute. The inlet opening is disposed within the air flow path of the volute generally transverse to the direction of air flow and receives a radially-inward portion of the air stream flowing within the volute (i.e., the relatively slower-moving portion of the air stream). Since it is presumed that the majority of dirt and particles will be entrained in the radially outermost portion of the air stream flowing in the volute (i.e., adjacent the curved outer wall), the air entering the inlet opening should be relatively free of dirt. However, this presumption fails to account for the air with entrained dirt that flows radially outward from the fan, a portion of such radially-flowing dirt being directly introduced into the inlet opening of the air inlet tube and contaminates the carburetor.

Another type of centrifugal air cleaner is taught in U.S. Pat. No. 4,261,302, which shows an air inlet opening formed in a bottom wall of a fan housing. Upstream of the air inlet, an upwardly curved lip is provided to deflect dirt within the air stream upwardly and away from the air inlet. An upwardly sloping ramp downstream of the air inlet also diverts dirt away from the air inlet. However, the air cleaning system shown in the '302 patent does not provide means for preventing radially propelled dirt from reaching the air inlet port.

Therefore, there exists a need in the art for a device which takes full advantage of the centrifugal air cleaning ability available in portable power equipment while eliminating or removing the shortcomings of the presently known centrifugal air cleaning devices.

SUMMARY OF THE INVENTION

The present invention is directed toward an improved centrifugal air cleaning system and to a portable power tool incorporating such an improved centrifugal air cleaning system.

In accordance with the present invention, the improved centrifugal air cleaning system includes a fan, a chassis section including a curved outer wall and a base wall which cooperate to define a fan volute. A deflector wall projects from the base wall and is located intermediate the fan and the outer wall. An air inlet port is formed in the base wall and is located between the deflector wall and the outer wall.

In further accordance with the present invention, the deflector wall includes a first wall portion and a second wall portion. The first wall portion has a curvature generally matching a curvature of the fan while the second wall portion diverges from the first wall portion and the fan toward the outer wall. The first wall portion prevents radially projected particles from reaching the air inlet port while the second wall portion cooperates with the outer wall to define a restricted flow path downstream of the air inlet port that creates a relatively high pressure condition at the inlet port and injects substantially particle-free air into the carburetor.

The present invention also provides an improved chassis section having a generally planar base wall from which a curved outer wall and a deflector wall project. The outer and deflector walls cooperate with the base wall to define a fan volute in which air, and particles entrained therein, flow. An air inlet port is formed in the base wall intermediate the deflector and outer walls.

In further accordance with the present invention, the deflector wall cooperates with the outer wall to define an air passageway which is relatively smaller at a location, in the direction of air flow within the fan volute, downstream of the air inlet port to create a relatively high pressure condition at the air inlet port. The high pressure condition causes substantially particle-free air to be injected from the fan volute into the air inlet port.

BRIEF DESCRIPTION OF THE DRAWINGS

These and further features of the present invention will be apparent with reference to the following description and drawings, wherein:

FIG. 3 is a front or exterior elevational view of a first chassis section of the chain saw shown in FIGS. 1 and 2;

FIG. 4 is a rear or interior elevational view of the first chassis section shown in FIG. 3;

FIG. 5 is an enlarged front or exterior elevational view of the first chassis section shown in FIGS. 2 and 3;

FIG. 6 is a cross-sectional view of the first chassis section as seen from line 6—6 of FIG. 5;

DETAILED DESCRIPTION OF THE PREFERRED EMBODIMENT

Figure 1:
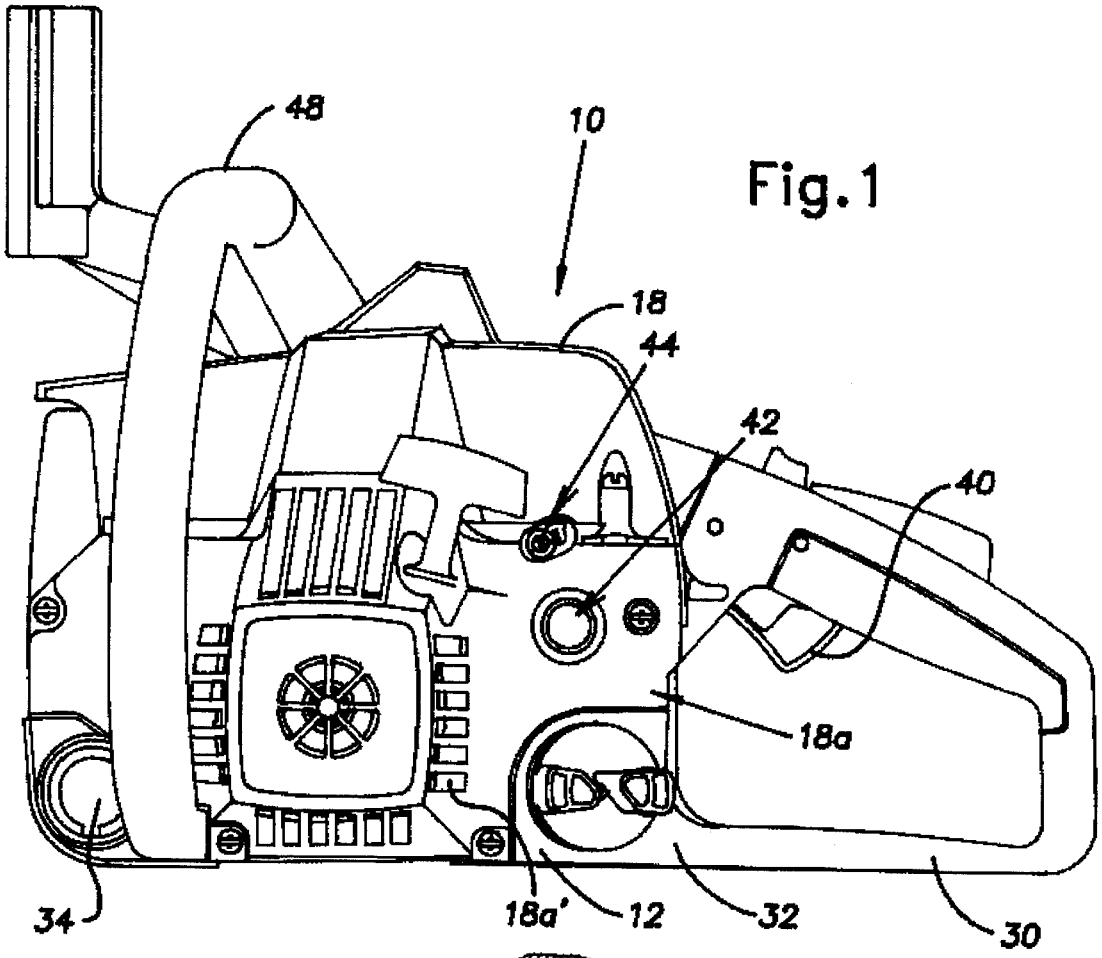
FIG. 1 is a front elevational view of a chain saw incorporating the present invention.

FIG. 1 illustrates a power head of a chain saw 10 which incorporates the centrifugal air cleaning system of the present invention. The chain saw 10 includes first and second chassis sections 12, 14 (FIGS. 3–8) to which an internal combustion engine 16 is mounted. A series of guards or covers 18, including a protective fan cover 18*a*, are secured to the chassis sections 12, 14 by conventional fasteners, as illustrated.

Figure 2:
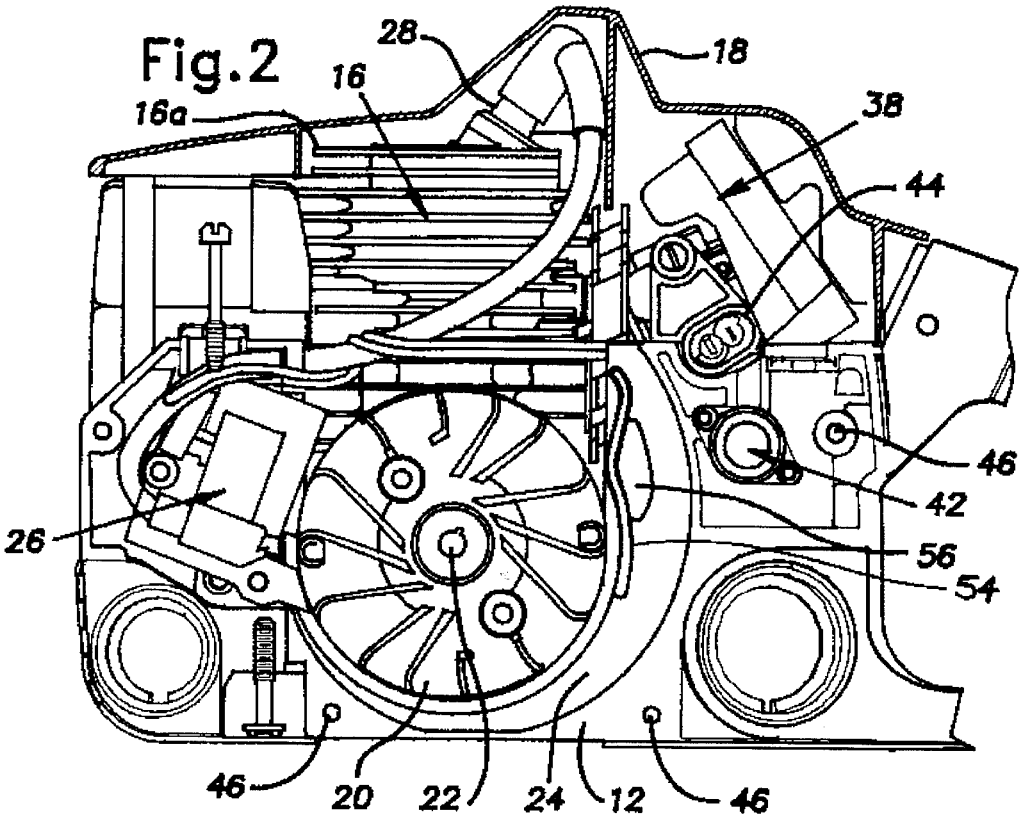
FIG. 2 is an enlarged front elevational view of the chain saw shown in FIG. 1, with portions removed for clarity.

A flywheel or fan 20 is mounted to a crankshaft 22 extending from the engine 16, and is rotationally driven by the crankshaft 22 (FIG. 2). A fan volute 24 radially surrounds the fan 20, the fan volute 24 being defined primarily by the first chassis section 12 and covered or enclosed by the fan cover 18*a*. An ignition module 26 is mounted to the first chassis section 12 adjacent the flywheel 20 and supplies spark-producing current pulses to a spark plug 28 as the flywheel 20 rotates, as is well known in the art.

Figure 7:
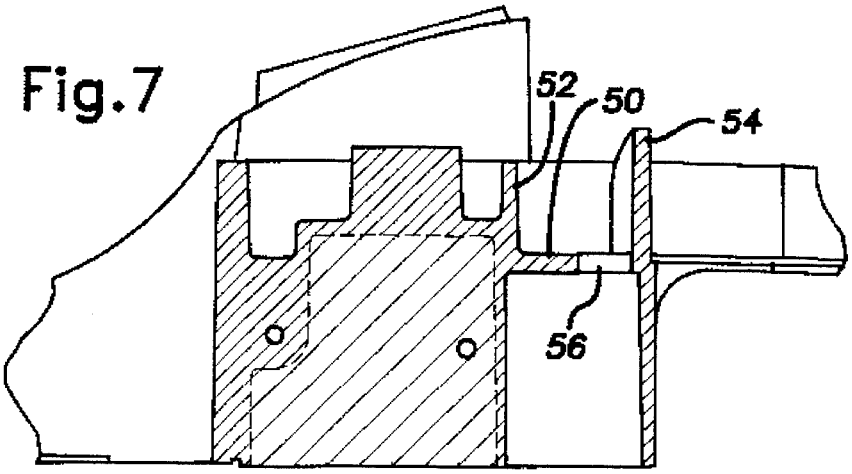
FIG. 7 is a cross sectional view of a portion of the first chassis section, as viewed along line 7—7 of FIG. 4.

The first chassis section 12, shown best in FIGS. 3, 4 and 7, is preferably injection molded or die cast from nylon plastic and cooperates with the second chassis section 14 (FIG. 8) to define or provide a rear handle 30, a fuel tank 32, an oil tank 34, and a carburetor air box 36. The chassis sections 12, 14 provide mounting locations for various control and operational elements, such as the carburetor 38, engine 16, throttle 40, primer bulb 42, and carburetor adjustment screws 44, as shown best in FIG. 2. The chassis sections 12, 14 also include a series of screw receiving bosses 46 to facilitate mounting of the protective covers or guards 18, 18*a* and for attachment of an upper handle 48 thereto.

One skilled in the art will recognize that the foregoing describes the environment in which the centrifugal air cleaning system of the present invention is employed, and does not limit the scope Of the present invention in any way. One skilled in the art will also appreciate that the present invention, to be described hereafter, can be incorporated into any known portable power tool chassis or fan housing.

With reference to FIGS. 3–7, the first chassis section 12 includes a base wall 50 radially surrounding the fan 20, a curved outer wall 52, and a deflector wall 54 which cooperate to define the fan volute 24. The base wall 50 defines a generally vertical plane. The protective fan cover 18*a* (FIG. 1), which has several air holes or openings 18*a* ' therein, overlies the fan 20 and the fan volute 24 and is removably secured to the first chassis section 12. A carburetor inlet opening or port 56 is defined or formed in the base wall 50 intermediate the deflector wall 54 and the outer wall 52, as illustrated.

With specific reference to FIG. 5, the deflector wall 54, which preferably is integrally formed with the base wall 50, is shown to include first, second, and third wall portions 54*a*, 54*b*, 54*c*. The first wall portion 54*a* has a curvature generally matching a curvature of the fan 20. The second wall portion 54*b* diverges from the first wall portion 54*a* and the fan 20 toward the outer wall 52. The third wall portion 54*c* has a shape generally matching the curvature of the outer wall 52, as illustrated.

The inlet opening or port 56 is radially adjacent the deflector wall 54 and has a peripheral shape, at least a portion of which generally conforms to the shape of a portion of the deflector wall 54. More specifically, the inlet opening 56 extends adjacent part of the first and second wall portions 54*a*, 54*b*. The inlet opening 56 has a length dimension generally in the direction of air flow within the fan volute 24 and a width dimension generally transverse to the air flow within the fan volute 24. Preferably, the inlet opening's length dimension is greater than its width dimension, as illustrated.

With specific reference to FIG. 6, the first wall portion 54*a* is shown to have a height dimension which gradually increases from a minimum at a first end 54*a*' remote from the second wall portion 54*b* until it generally equals the height dimension of the second wall portion 54*b* at a second end 54*a*" which merges with the second wall portion 54*b*. The second and third wall portions 54*b*, 54*c* preferably have generally constant and equal height dimensions, as illustrated.

Rotation of the fan 20 about its axis of rotation (i.e., crankshaft 22) draws ambient air and entrained dirt or particles into the fan volute 24 through the openings 18*a*' formed in the protective fan cover 18*a*, and creates an air stream with entrained particles in the fan volute 24. The air stream flows within the fan volute 24 in a direction generally tangential to the fan 20 (see arrows labelled "A" in FIG. 5). Due to centrifugal forces, the dirt and heavier-than-air particles tend to flow in the radially outermost portion of the air stream adjacent the curved outer wall 52 while the radially innermost portion of the air stream (i.e., near the deflector wall 54) tends to be substantially free of tangentially-projected dirt or particles.

Figure 8:
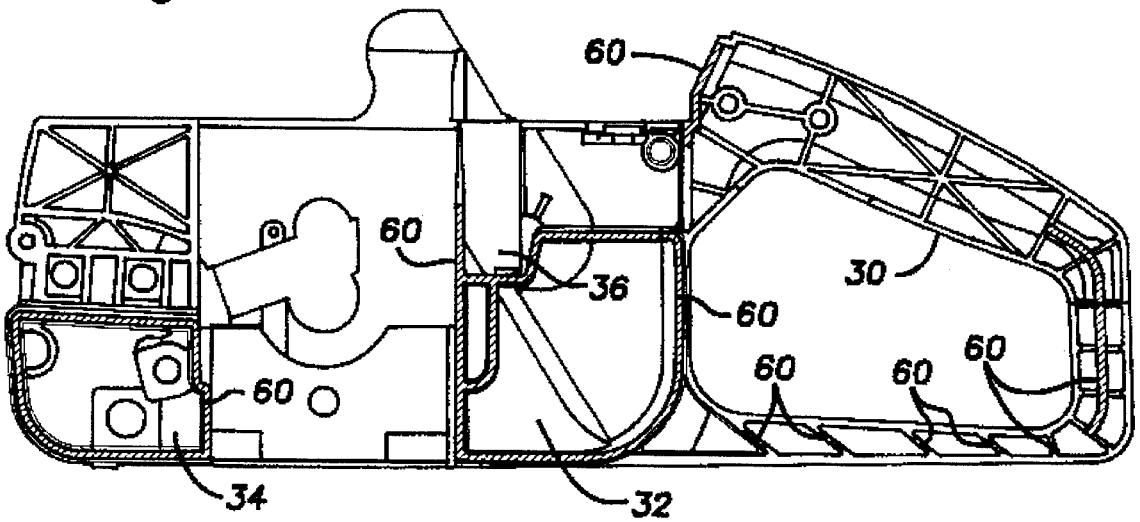
FIG. 8 is an interior or rear elevational view of a second chassis section.

The second and third wall portions 54*b*, 54*c* of the deflector wall 54 cooperate with the curved outer wall 52 to define a restriction R or restricted flow path for the air stream. The restriction R is located downstream of the inlet opening or port 56 and creates a relatively high pressure condition at the inlet opening 56 which forces or injects some of the radially innermost, dirt-free portion of the air stream through the inlet opening 56 and into the carburetor air box 36 (FIGS. 4 and 8). The remainder of the air stream and all of the dirt passes through the restriction R and flows over cooling fins 16*a* on the exterior of the engine 16, cooling the engine.

In addition to preventing tangentially-propelled dirt from reaching the air inlet opening 56, the deflector wall 54 prevents dirt which is projected radially by the fan 20 from reaching and flowing into the inlet opening 56 (see arrows labelled "B" in FIG. 5). The majority of the radially-projected dirt which would otherwise reach the inlet opening 56 strikes the deflector wall 54 and is thereafter directed between the fan 20 and the deflector wall 54 toward the engine cooling fins 16*a* (see arrow "C").

The small portion of radially projected dirt which flows over the deflector wall 54 will not be able to make the sharp and immediate change of direction necessary to enter the inlet opening 56 and will, instead, merge with the majority of the air stream as it passes through the restriction R between the third wall portion 54*c* and the outer wall 52 and flows over the exterior portion of the engine.

Preferably, the first and second chassis sections 12, 14 cooperate to define at least a portion of the carburetor air box 36 in which the carburetor 38 is mounted. Clean air injected into the air inlet opening or port 56 creates an above-atmospheric pressure condition in the carburetor air box 36. Maintaining the carburetor air box 36 at an elevated pressure causes air to flow outwardly through any gaps or spaces in the air box, and thereby further prevents or minimizes the possibility of any foreign dirt or particles from being introduced into the carburetor 38.

With reference to FIGS. 4, 7, and 8, the interior of the first and second chassis sections 12, 14 are illustrated. The hatched surfaces 60 on each chassis section identify surfaces of the chassis sections 12, 14 which are to be joined in a water-tight fashion, preferably by vibration welding. Portions of the fuel and oil tanks 32, 34 are provided by each chassis section 12, 14, and vibration welding of the chassis sections integrally defines the tanks.

The air inlet port 56 supplies clean air to the carburetor air box 36 which is defined, in part, by the cooperation of the chassis sections 12, 14. The carburetor 38 (FIG. 2) is preferably attached to the second chassis section 14 and generally serves to seal off the open end of the carburetor air box 36.

While the preferred embodiment of the present invention is shown and described herein, it is to be understood that the same is not so limited but shall cover and include any and all modifications thereof which fall within the purview of the invention as defined by the claims appended hereto.

What is claimed is:

1. A portable power tool comprising a chassis, an engine secured to said chassis, and a fan connected to said engine and rotatably driven by said engine about an axis, said chassis including a base wall radially spaced from said fan, a curved outer wall radially surrounding at least a portion of said fan, and a deflector wall, said base wall and said outer wall cooperating to define a portion of a fan volute in which air, and particles entrained therein, are propelled by said fan, said base wall having a carburetor air inlet port formed therein, said deflector wall projecting from said base wall on a side of said air inlet port opposite said outer wall and between said fan and said air inlet port, said deflector wall cooperating with said outer wall to define an air passageway, said air passageway being relatively smaller at a location, in a direction of air flow within said fan volute, downstream from said air inlet port.

2. A portable power tool according to claim 1, wherein said air inlet port is formed in said base wall at a location radially adjacent said deflector wall.

3. A portable power tool according to claim 2, wherein said deflector wall includes a first wall portion and a second wall portion, said first wall portion having a curvature which generally matches a curvature of said fan while said second wall portion diverges from said fan toward said outer wall.

4. A portable power tool according to claim 3, wherein said air inlet port has a periphery which conforms to a shape of at least a portion of said first and second wall portions.

5. A portable power tool according to claim 4, wherein the inlet port has a length dimension generally in the direction of air flow within the volute and a width dimension generally transverse to the direction of air flow within the volute, said length dimension being greater than said width dimension.

6. A portable power tool according to claim 3, wherein said air passageway has a generally constant area at said first wall portion and gradually reduces in area as said second wall portion extends away from said first wall portion.

7. A portable power tool according to claim 6, wherein a height dimension of said first wall portion gradually decreases as said first wall portion extends away from said second wall portion, said second wall portion having a generally constant height dimension.

8. A portable power tool according to claim 3, wherein said deflector wall includes a third wall portion, said third wall portion extending from said second wall portion and having a curvature which generally conforms to a curvature of said outer wall.

9. A centrifugal air cleaning system for a portable power tool, comprising a fan, a fan volute defined, in part, by a curved outer wall and a base wall, a carburetor air inlet port formed in said base wall between said fan and said outer wall, and a deflector wall projecting from said base wall intermediate said fan and said air inlet port, wherein said deflector wall includes a first wall portion having a curvature which generally matches a curvature of said fan and a second wall portion which diverges from said fan toward said outer wall, said first wall portion generally preventing particles which are radially projected from said fan from reaching the carburetor air inlet port and said second wall portion cooperating with said outer wall to define a restricted flow path for an air stream flowing within said fan volute, said restricted flow path being located, in a direction of air flow within said fan volute, relatively downstream of said air inlet port.

10. A centrifugal air cleaning system according to claim 9, wherein said air inlet port is formed in said base wall at a location radially adjacent said deflector wall.

11. A centrifugal air cleaning system according to claim 10, wherein said air inlet port has a periphery which conforms to a shape of at least a portion of said first and second wall portions.

12. A centrifugal air cleaning system according to claim 11, wherein the air inlet port has a length dimension generally in the direction of air flow within the volute and a width dimension generally transverse to the direction of air flow within the volute, said length dimension being greater than said width dimension.

13. A centrifugal air cleaning system according to claim 9, wherein said air passageway has a generally constant area at said first wall portion and gradually reduces in area as said second wall portion extends away from said first wall portion.

14. A centrifugal air cleaning system according to claim 13, wherein a height dimension of said first wall portion gradually decreases as said first wall portion extends away from said second wall portion, said second wall portion having a generally constant height dimension.

15. A centrifugal air cleaning system according to claim 9, wherein said deflector wall includes a third wall portion, said third wall portion extending from said second wall portion and having a curvature which generally conforms to a curvature of said outer wall.

16. A portable power tool chassis comprising a generally planar base wall, a curved outer wall, and a deflector wall, said outer wall and said deflector wall projecting from said base wall and cooperating with said base wall to define a portion of a fan volute in which air, and particles entrained therein, may be propelled, an air inlet port being formed in said base wall intermediate said deflector wall and said outer wall, said deflector wall cooperating with said outer wall to define an air passageway, said air passageway being relatively smaller at a location, in a direction of air flow within said fan volute, downstream of said air inlet port.

17. A portable power tool chassis according to claim 16, wherein said deflector wall includes a first wall portion and a second wall portion, said second wall portion diverging from said first wall portion toward said outer wall.

18. A portable power tool chassis according to claim 17, wherein said deflector wall includes a third wall portion, said third wall portion extending from said second wall portion and having a curvature which generally conforms to a curvature of said outer wall.

19. A portable power tool chassis according to claim 18, wherein said air inlet port is formed in said base wall at a location radially adjacent said deflector wall.

20. A portable power tool chassis according to claim 19, wherein said air inlet port has a periphery which conforms to a shape of at least a portion of said first and second wall portions.

21. A portable power tool chassis according to claim 20, wherein the inlet port has a length dimension generally in the direction of air flow within the volute and a width dimension generally transverse to the direction of air flow within the volute, said length dimension being greater than said width dimension.

22. A portable power tool chassis according to claim 17, wherein said air passageway has a generally constant area at said first wall portion and gradually reduces in area as said second wall portion extends away from said first wall portion.

23. A portable power tool chassis according to claim 17, wherein a height dimension of said first wall portion gradually decreases as said first wall portion extends away from said second wall portion, said second wall portion having a generally constant height dimension.

* * * * *